US008328392B2

(12) United States Patent
Hung et al.

(10) Patent No.: US 8,328,392 B2
(45) Date of Patent: Dec. 11, 2012

(54) LED ILLUMINATION LAMP WITH MATRIX-ARRANGED LEDS AND REFLECTORS

(75) Inventors: Pei-Yuan Hung, Miao-Li Hsien (TW); Chih-Ming Lai, Miao-Li Hsien (TW)

(73) Assignee: Foxsemicon Integrated Technology, Inc., Chu-Nan, Miao-Li Hsien, (TW)

( * ) Notice: Subject to any disclaimer, the term of this patent is extended or adjusted under 35 U.S.C. 154(b) by 283 days.

(21) Appl. No.: 12/848,208

(22) Filed: Aug. 1, 2010

(65) Prior Publication Data

US 2011/0305015 A1 Dec. 15, 2011

(30) Foreign Application Priority Data

Jun. 15, 2010 (CN) ..... 2010 1 0200941

(51) Int. Cl.
*F21S 4/00* (2006.01)

(52) U.S. Cl. ..... 362/249.02; 362/241; 362/247

(58) Field of Classification Search ..... 362/249.02, 362/241–243, 247, 248, 245–246, 346, 342; 257/98

See application file for complete search history.

(56) References Cited

U.S. PATENT DOCUMENTS 7,182,480 B2 * 2/2007 Kan ..... 362/242
7,229,194 B2 * 6/2007 Liu et al. ..... 362/225
7,758,212 B2 * 7/2010 Jan et al. ..... 362/249.02

* cited by examiner

*Primary Examiner* — Robert May
(74) *Attorney, Agent, or Firm* — Altis Law Group, Inc.

(57) ABSTRACT

An LED illumination unit includes a substrate, a plurality of LEDs mounted on the substrate and arranged in rows and columns to form an LED array, and a corresponding number of plate-type light reflectors mounted on the substrate. The LED array has a center and a symmetrical axis across the center. The LEDs is arranged symmetrically on the substrate with respect to the symmetrical axis. Each light reflector is paired with an LED and disposed immediately adjacent to the LED. Each light reflector has a light reflecting surface facing the LED. The light reflectors each defines a mounting angle relative to the symmetrical axis, and the mounting angle is an angle from 0 to 90 degrees. An LED illumination lamp incorporating a plurality of the LED illumination units is also disclosed.

3 Claims, 14 Drawing Sheets

LED ILLUMINATION LAMP WITH MATRIX-ARRANGED LEDS AND REFLECTORS

BACKGROUND

1. Technical Field

The present disclosure relates to illumination lamps and, more particularly, to an LED illumination unit and an LED illumination lamp having a plurality of the LED illumination units incorporated therein.

2. Description of Related Art

LEDs, available since the early 1960's and because of their high light-emitting efficiency, have been increasingly used. According to Illuminating Engineering Society of North America (IESNA), illumination distribution of lighting used in some occasions, such as squares, sidewalks, yards, parks, or parking lots must meet the standards of Type IV or Type V. These two types of standards require that the light illuminating on the site has a circular or square pattern, in which the light source is located at a center of the pattern. However, the light directly emitted from the LEDs usually cannot meet such a requirement. To meet the requirement, a lens which can modulate the light distribution of the LEDs may be used. However, the lens is expensive and when light travels through the lens the intensity of the light is significantly reduced. A light reflector is cheaper than a lens and the light intensity will not be significantly reduced when the light is reflected by a light reflector.

What is needed, therefore, is an LED illumination lamp having light reflectors incorporated therein which can modulate the light generated by the LED illumination lamp so that the light pattern can meet the standards of IESNA Type VI and Type V.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
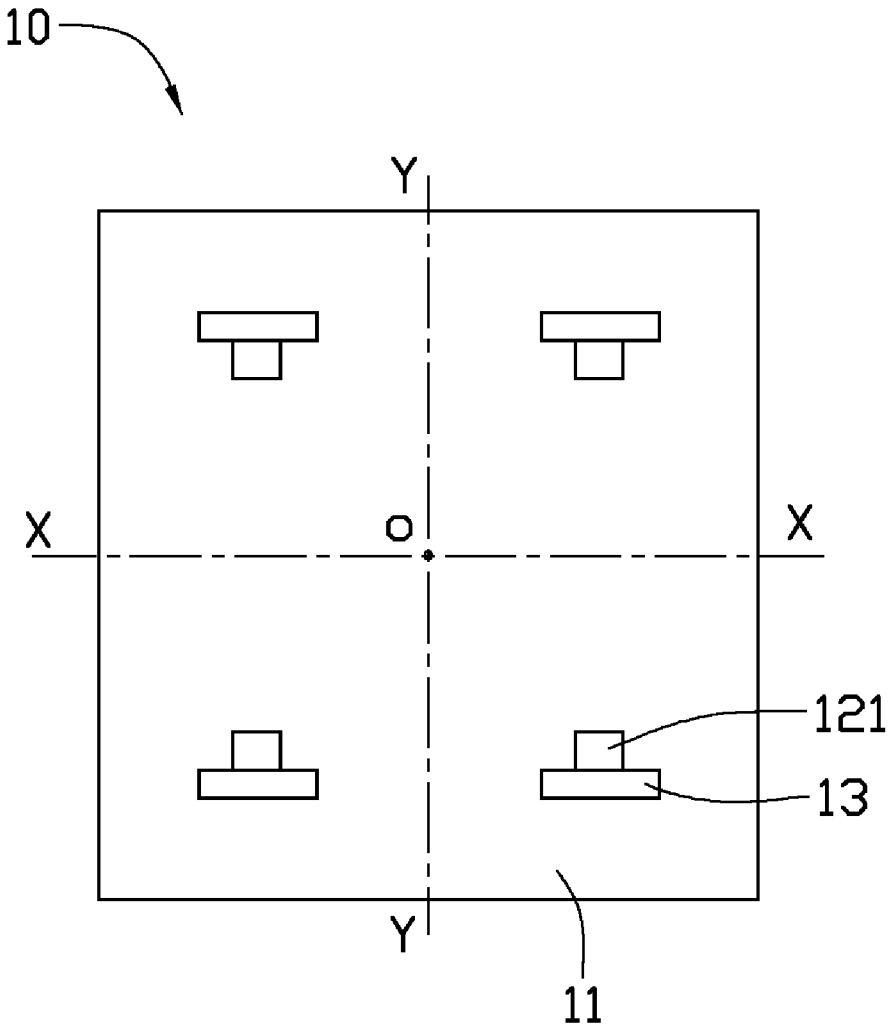
FIG. 1 is a plan view of an LED illumination unit according to a first embodiment of the present disclosure.
Figure 2:
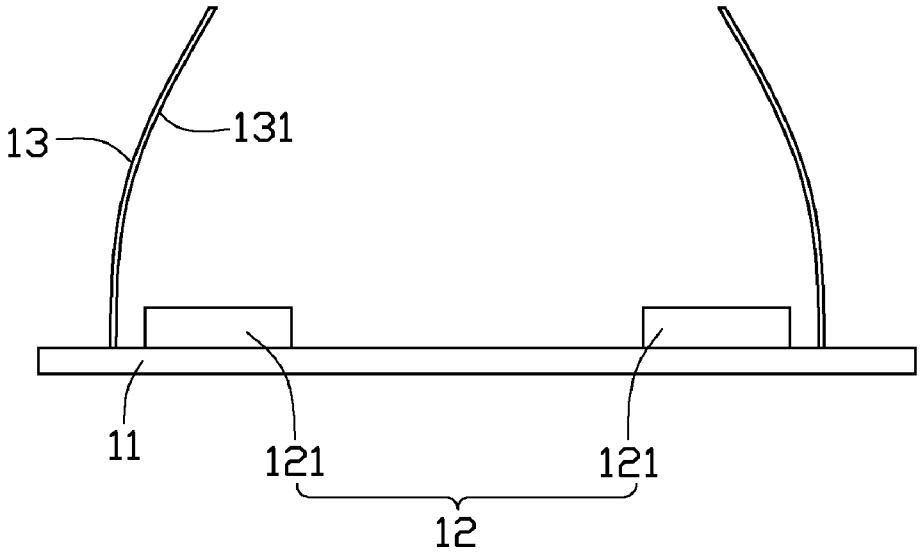
FIG. 2 is a side view of the LED illumination unit of FIG. 1.

Referring to FIGS. 1-2, an LED illumination unit 10 according to a first embodiment of the present disclosure is disclosed. The LED illumination unit 10 includes a substrate 11, a plurality of LEDs 121 mounted on the substrate 11 and a corresponding number of light reflectors 13 mounted on the substrate 11. The LEDs 121 are spaced from each other and arranged in rows and columns on the substrate 11 to form an LED array 12. Each of the LEDs 121 is paired with a light reflector 13 which is disposed immediately adjacent to the LED 121. In the embodiment, there are four LEDs 121 and four light reflectors 13 on the substrate 11, and the LEDs 121 are arranged in two rows and in two columns. Each LED 121 is located near a corner of the substrate 11.

The LED array 12 has a center O, a symmetrical axis X-X across the center O along a left to right direction, and a symmetrical axis Y-Y across the center O along a front to rear direction. The symmetrical axis X-X is perpendicular to the symmetrical axis Y-Y. The LEDs 121 are symmetrically arranged on the substrate 11 with respect to the symmetrical axis X-X. Also, the LEDs 121 are symmetrically arranged on the substrate 11 with respect to the symmetrical axis Y-Y. Every two diagonal LEDs 121 are symmetrically arranged on the substrate 11 with respect to the center O. Each light reflector 13 is mounted on the substrate 11 with a predetermined mounting angle with respect to the symmetrical axis X-X. In the embodiment, each light reflector 13 defines a zero mounting angle with respect to the symmetrical axis X-X. In other words, each light reflector 13 is parallel to the symmetrical axis X-X.

Each LED 121 has an inner side adjacent to the symmetrical axis X-X and an outer side far away from the symmetrical axis X-X. In each pair of the LED 121 and the light reflector 13, the light reflector 13 is located at the outer side of the LED 121, and put in another way, the LED 121 is located at an inner side of the light reflector 13. The light reflector 13 is in the form of a plate with a bottom portion thereof being mounted in the substrate 11 and a top portion thereof being curved inwardly towards the LED 121, such that the top portion of the light reflector 13 is located above and covers a substantial portion of the LED 121. Alternatively, the plate-type light reflector 13 can also be planar and extends in an upright manner from the substrate 11. An inner surface of each light reflector 13 facing the LED 121 is formed as a light reflecting surface 131 for reflecting light emitted from the LED 121. The light reflectors 13 can be made of metal or plastics, with a light reflecting metal layer coated on the inner surface thereof to form the light reflecting surface 131.

In order to obtain a desired light pattern, the mounting angle of each light reflector 13 on the substrate 11 with respect to the symmetrical axis X-X can be varied. Other variants and examples of the LED illumination unit 10 are described below.

Figure 3:
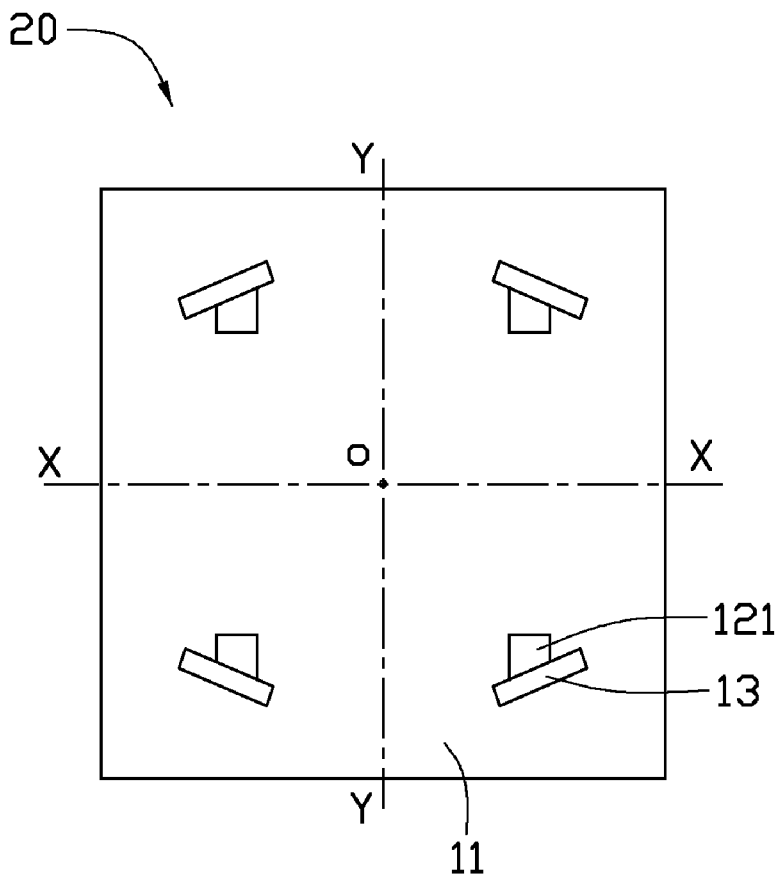
FIG. 3 is a plan view of an LED illumination unit according to a second embodiment of the present disclosure.
Figure 4:
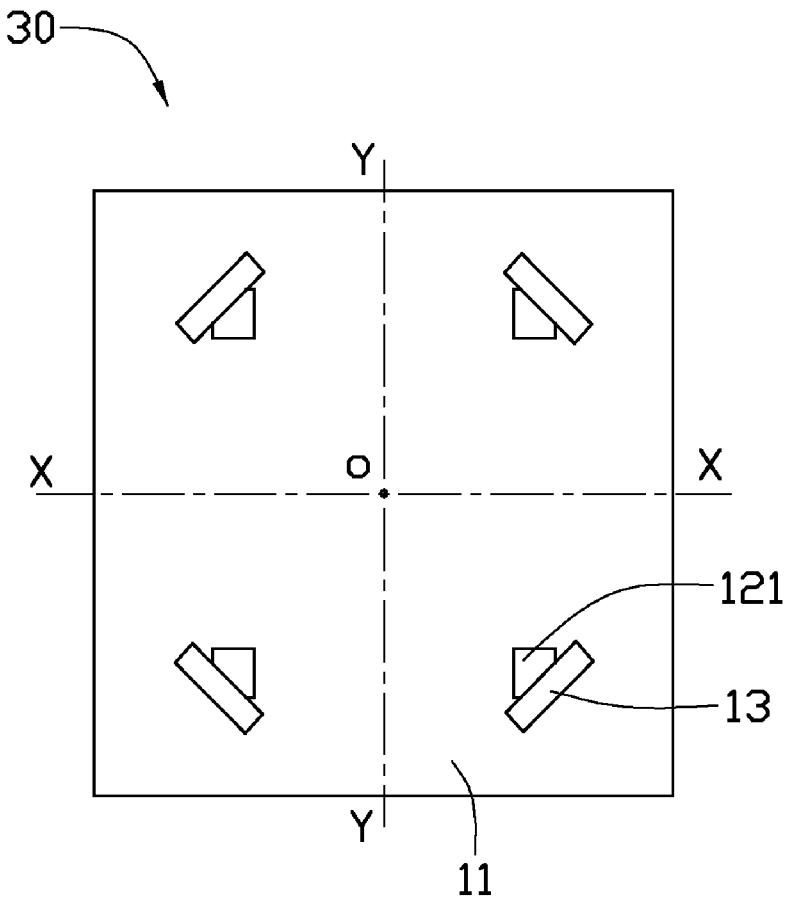
FIG. 4 is a plan view of an LED illumination unit according to a third embodiment of the present disclosure.
Figure 5:
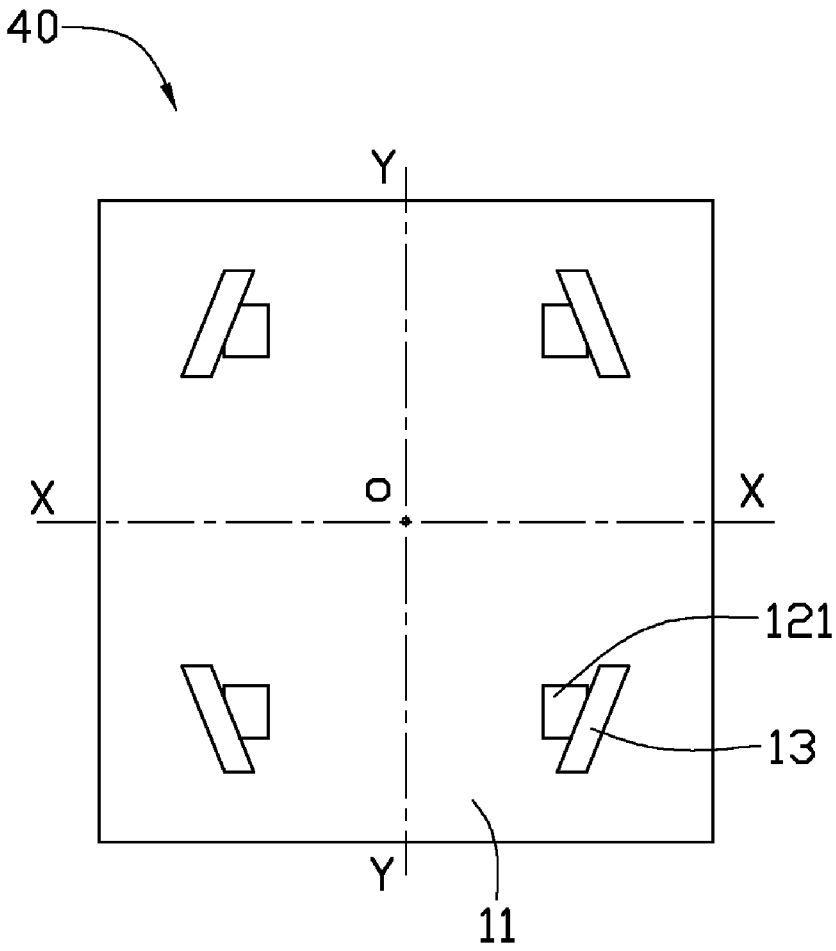
FIG. 5 is a plan view of an LED illumination unit according to a fourth embodiment of the present disclosure.
Figure 6:
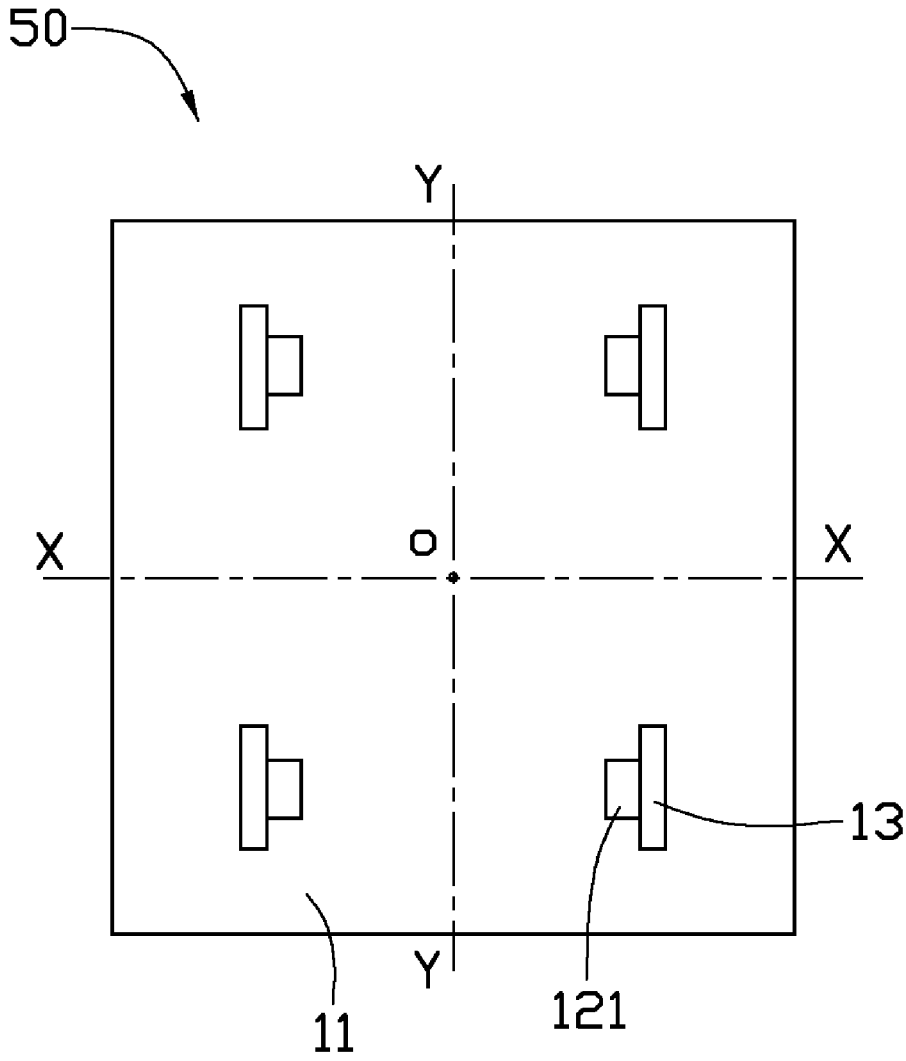
FIG. 6 is a plan view of an LED illumination unit according to a fifth embodiment of the present disclosure.

FIG. 3 shows an LED illumination unit 20 according to a second embodiment, in which each light reflector 13 forms a mounting angle of 22.5 degrees with respect to the symmetrical axis X-X. FIG. 4 shows an LED illumination unit 30 according to a third embodiment, in which each light reflector 13 forms a mounting angle of 45 degrees with respect to the symmetrical axis X-X. FIG. 5 shows an LED illumination unit 40 according to a fourth embodiment, in which each light reflector 13 forms a mounting angle of 67.5 degrees with respect to the symmetrical axis X-X. FIG. 6 shows an LED illumination unit 50 according to a fifth embodiment, in which each light reflector 13 forms a mounting angle of 90 degrees with respect to the symmetrical axis X-X. In fact, the mounting angle of the light reflector 13 with respect to the symmetrical axis X-X can be any angle ranged from 0 to 90 degrees.

In each of the LED illumination units 10, 20, 30, 40, 50, the light reflector 13 is mounted on the substrate 11 with a particular mounting angle relative to the symmetrical axis X-X. By regulating the mounting angle, a particular light pattern can be obtained by the LED illumination unit 10 (20, 30, 40, 50) to obtain a particular desired light pattern. The light emitted from each LED 121 at one side of the symmetrical axis X-X is mainly guided by the adjacent light reflector 13 towards the other side of the symmetrical axis X-X. The light reflected by the light reflectors 13 from the four LEDs 121 overlaps with each other, to thereby form an overlapped light pattern which is a symmetrically distributed light pattern having an approximately circular shape.

Figure 7:
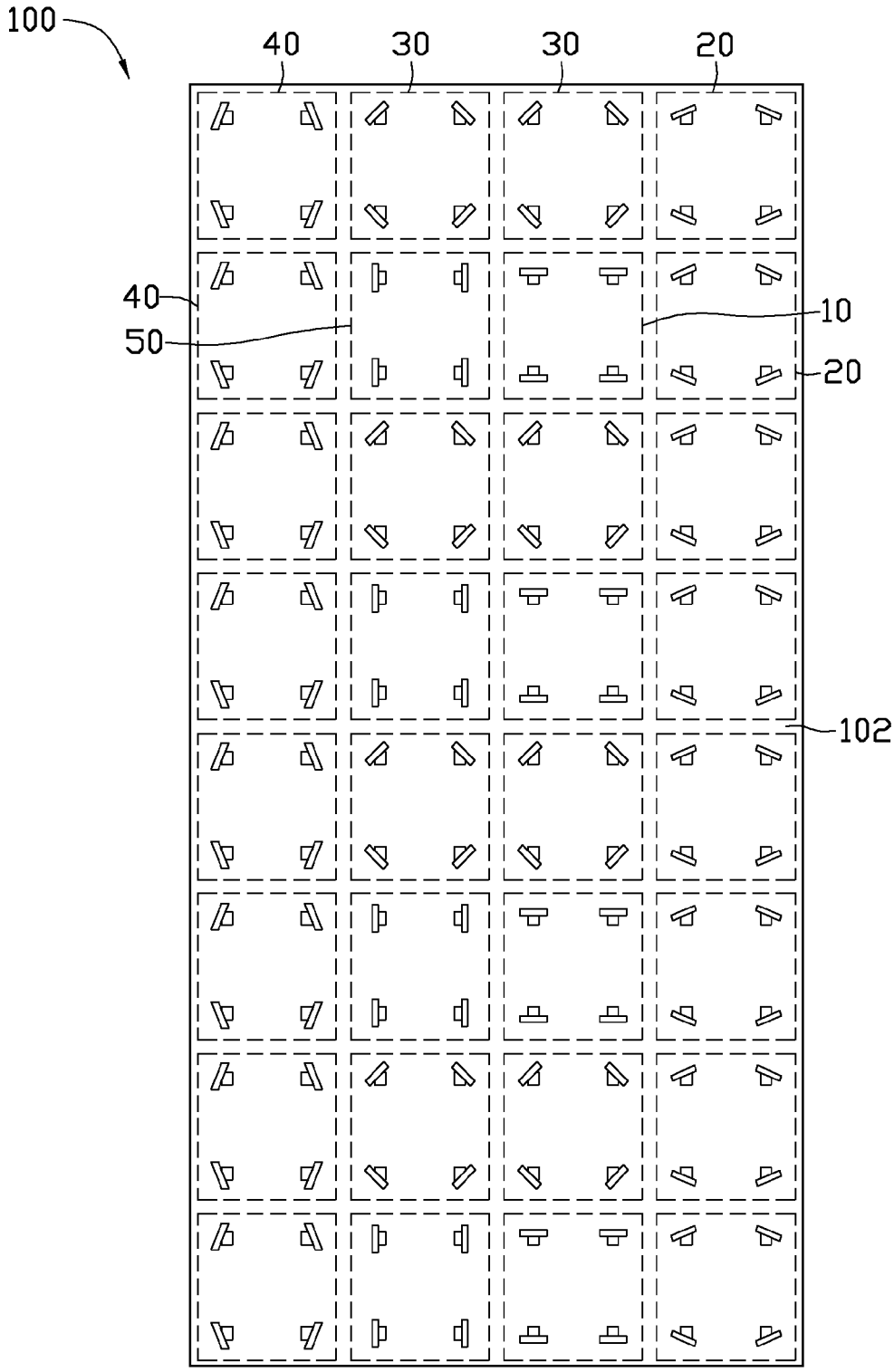
FIG. 7 is a plan view of an LED illumination lamp incorporating a plurality of the LED illumination units of FIGS. 1-6.

In order to obtain a required light pattern and get a required brightness, the LED illumination units 10, 20, 30, 40, 50 can be grouped together and arranged in a matrix to form an LED illumination lamp. FIG. 7 illustrates an LED illumination lamp 100 incorporating a plurality of the LED illumination units 10, 20, 30, 40, 50 which are arranged in a matrix in the LED illumination lamp 100. The LED illumination lamp 100 includes a substrate 102 and a plurality of the LED illumination units 10, 20, 30, 40, 50 mounted on the substrate 102 in a regular manner. The LED illumination units 10, 20, 30, 40, 50 are arranged on the substrate 11 in rows and columns. In the embodiment, the LED illumination units 10, 20, 30, 40, 50 are arranged in a four-column, eight-row matrix.

Figure 8:
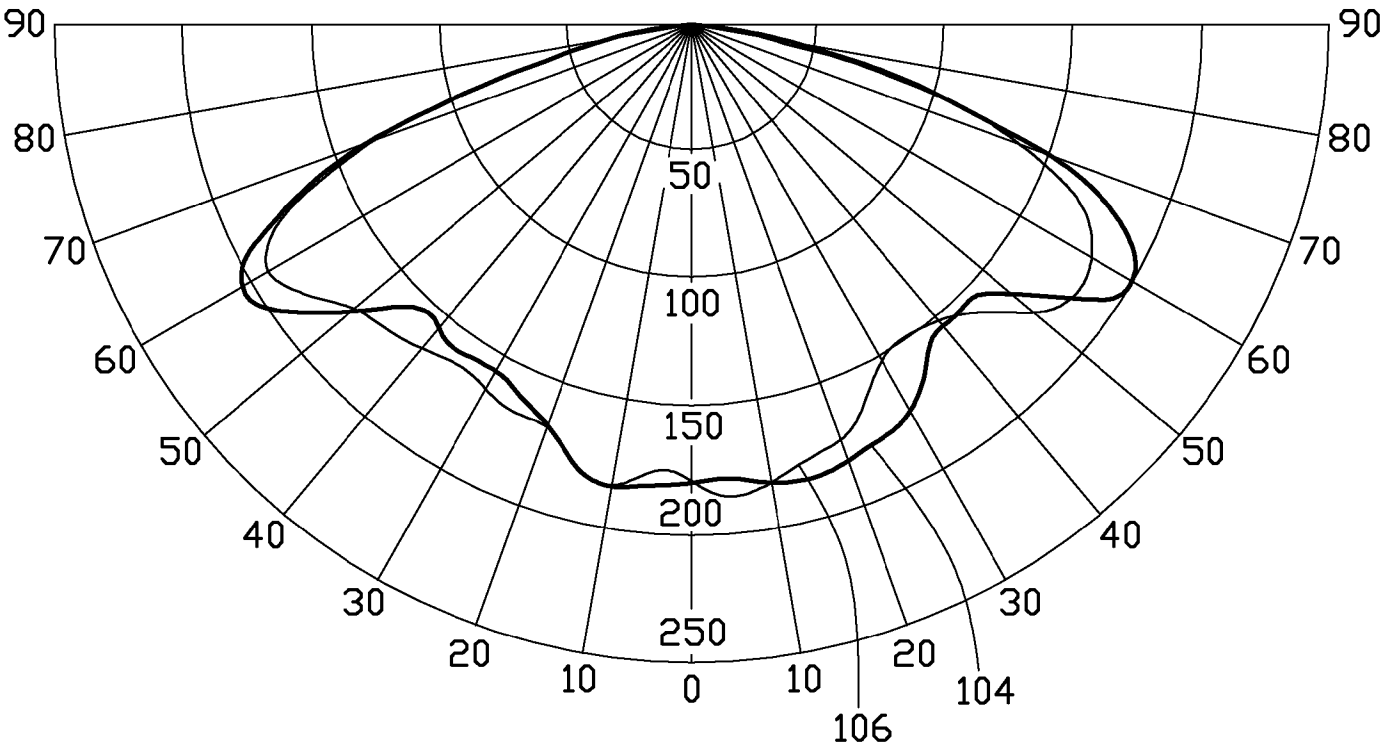
FIG. 8 shows photometric curves of the LED illumination lamp of FIG. 7.
Figure 9:
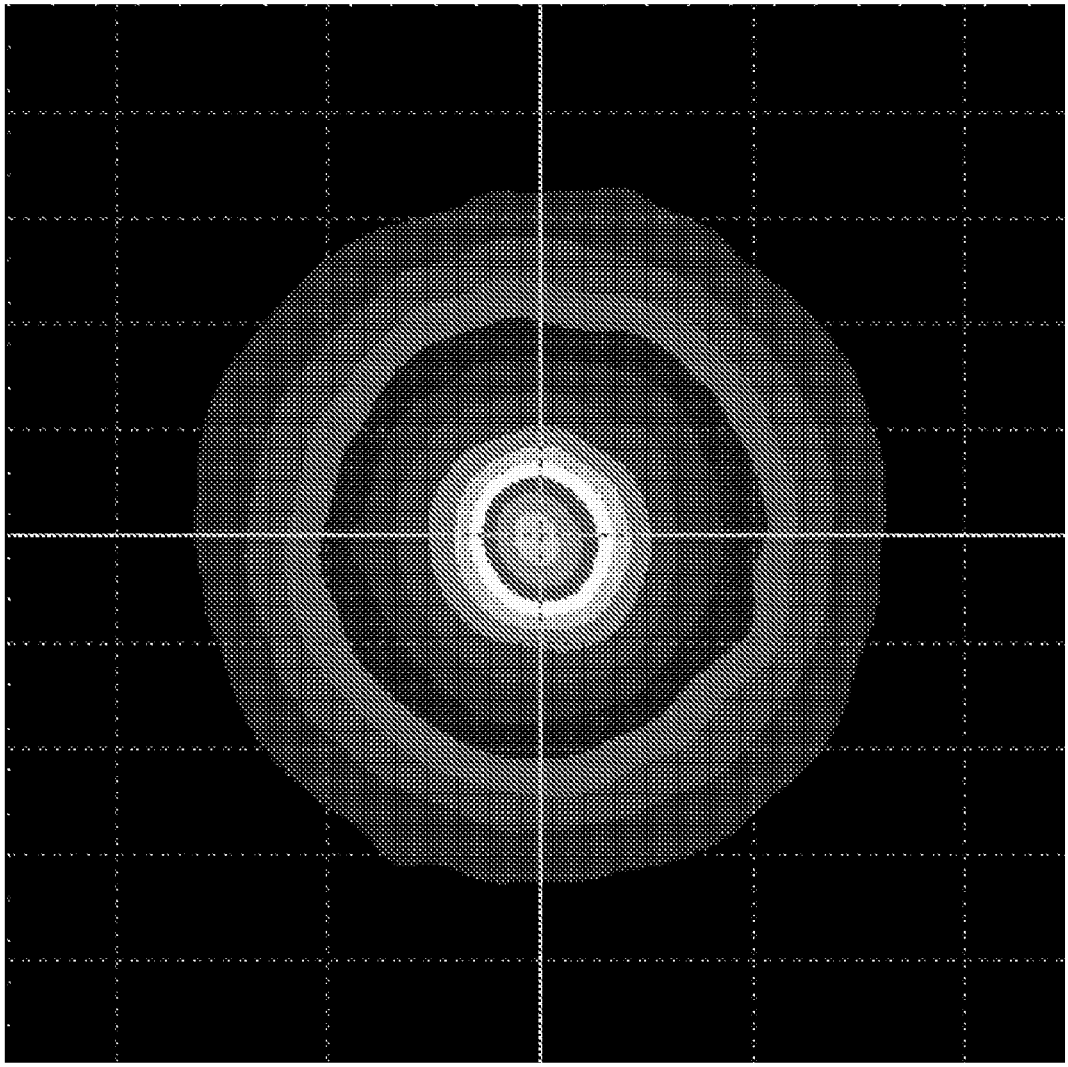
FIG. 9 shows a light pattern of the LED illumination lamp of FIG. 7.

FIG. 8 is a Candela plot showing photometric curves 104, 106 of the LED illumination lamp 100 of FIG. 7. The two photometric curves (i.e., the bold curve 104 and the thin curve 106) have similar shapes and are substantially overlapped, representing that the distribution of the light at the two orthogonal directions are approximate to each other. Thus, the light distribution of the LED illumination lamp 100 can have a desirable shape approximate to a circle as shown in FIG. 9, thereby meeting the Type IV and Type V illumination requirements of IESNA.

Figure 10:
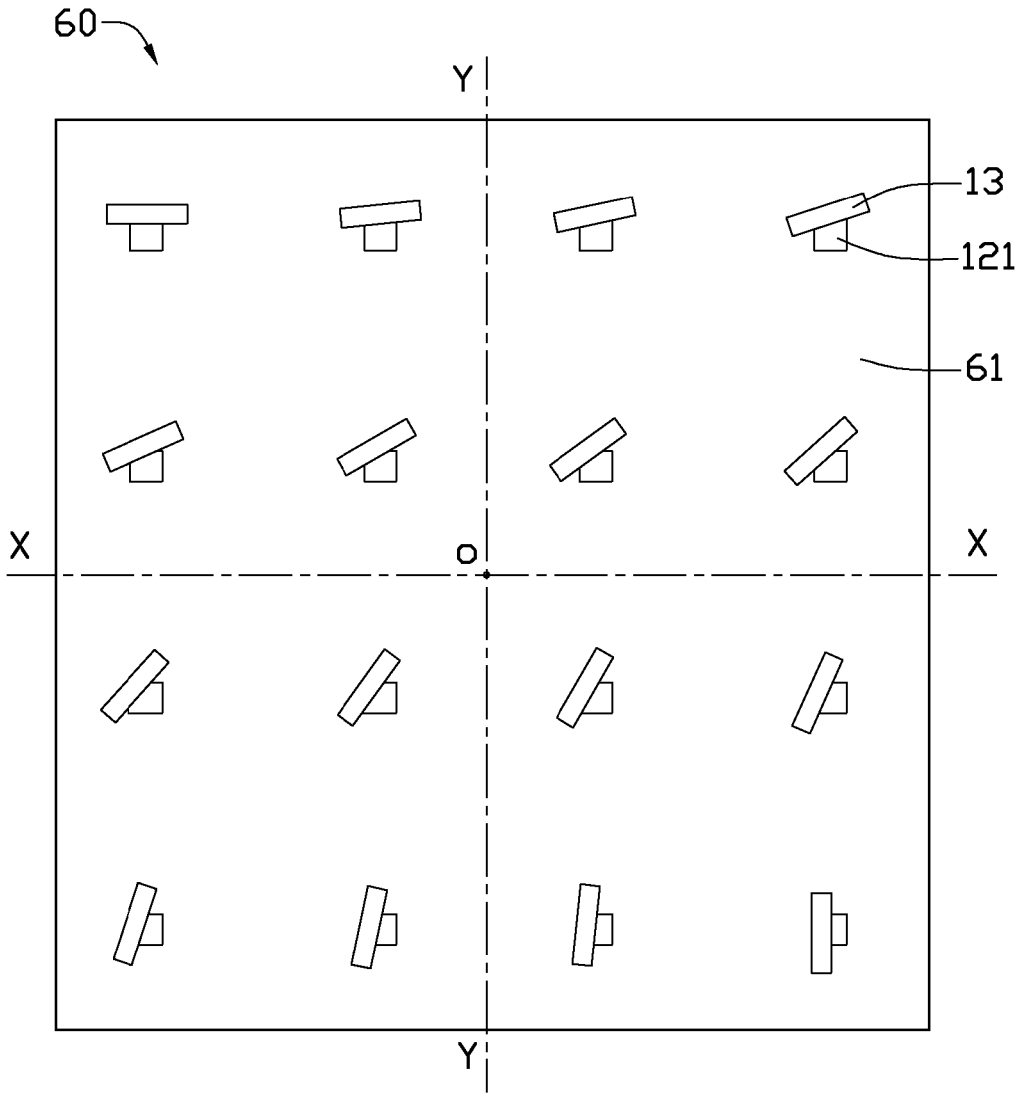
FIG. 10 is a plan view of an LED illumination unit according to a sixth embodiment of the present disclosure.

FIG. 10 shows an LED illumination unit 60 according to a sixth embodiment. The LED illumination unit 60 includes a substrate 61, a plurality of LEDs 12 on the substrate 61, and a corresponding number of light reflectors 13 on the substrate 61. The LEDs 121 are evenly spaced from each other and arranged in N rows and M columns on the substrate 61 to form an LED array, wherein N and M are natural number and greater than 1. Each light reflector 13 is paired with an LED 121 and disposed immediately adjacent to the LED 121. Thus, the light reflectors 13 are also arranged in N rows and M columns on the substrate 61.

Similar to the LED illumination unit 10 shown in FIG. 1, the LED array of the LED illumination unit 60 has a center O, a symmetrical axis X-X and a symmetrical axis Y-Y perpendicular to the symmetrical axis X-X. Each light reflector 13 defines a mounting angle relative to the symmetrical axis X-X. The mounting angles of the light reflectors 13 relative to the symmetrical axis X-X in each row are regularly varied, wherein a right light reflector 13 in each row of light reflectors 13 is deflected with a first predetermined angle relative to a neighboring left light reflector 13 in the same row of light reflectors 13. The mounting angles of the light reflectors 13 relative to the symmetrical axis X-X in each column of light reflectors 13 are also regularly varied, wherein a rear light reflector 13 in each column of light reflectors 13 is deflected with a second predetermined angle relative to a neighboring front light reflector 13 in the same column of light reflectors 13. The leftmost reflector 13 in a rear row of light reflectors 13 is deflected with the first predetermined angle relative to the rightmost light reflector 13 in a neighboring front row of light reflectors 13.

In the embodiment, the LEDs 121 and the light reflectors 13 are arranged in a four-row, four-column matrix. That is, the natural number of N and M each are 4. The mounting angles of the four LEDs 121 in the first row are respectively 0, 6, 12, 18 degrees from the left to right direction. The mounting angles of the four LEDs 121 in the second row are respectively 24, 30, 36, 42 degrees from the left to right direction. The mounting angles of the four LEDs 121 in the third row are respectively 48, 54, 60, 66 degrees from the left to right direction. The mounting angles of the four LEDs 121 in the fourth row are respectively 72, 78, 84, 90 degrees from the left to right direction. The first predetermined angle is 6 degrees, and the second predetermined angle is 24 degrees. However, it is noted that the value of N and M, the first predetermined angle and the second predetermined angle are not limited to the above and can be changed according to application and requirement. It is preferred that the first predetermined angle is larger than 0 degree but smaller than 30 degrees.

Figure 11:
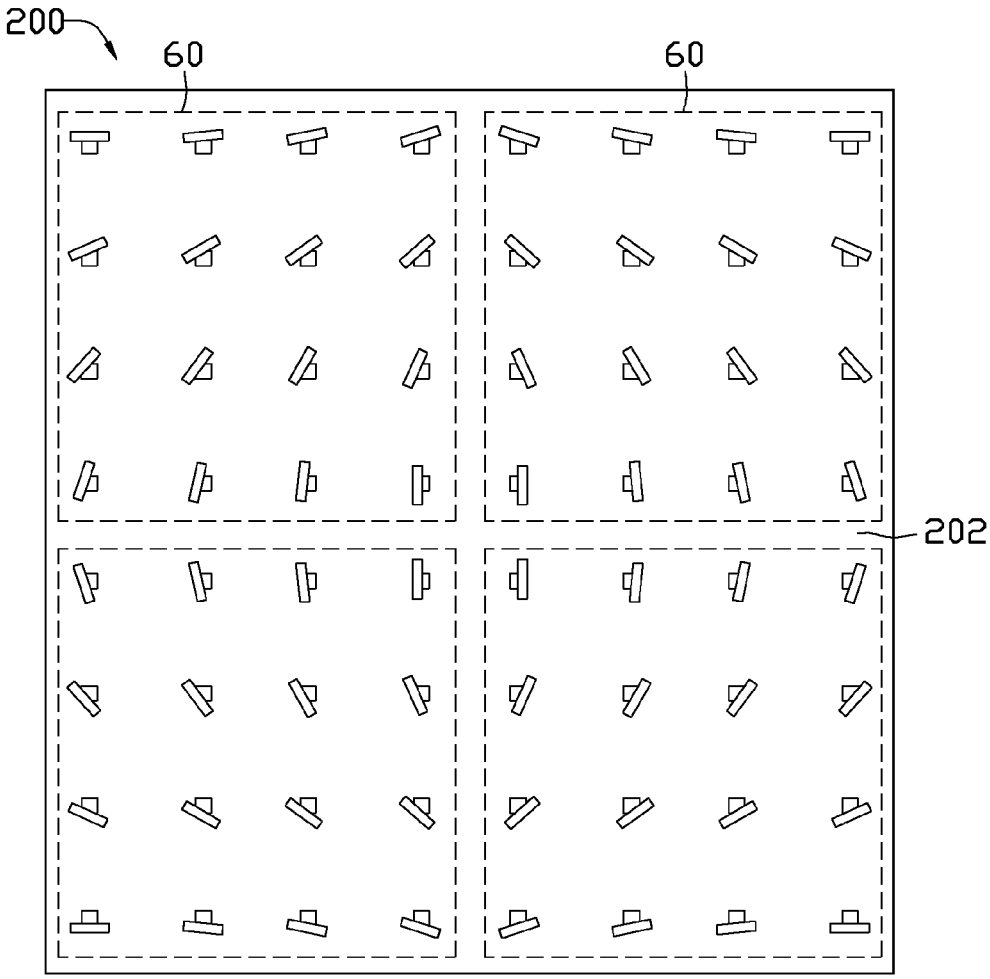
FIG. 11 is a plan view of an LED illumination lamp incorporating a plurality of the LED illumination units of FIG. 10.

In order to obtain a required light pattern and get a desired brightness, a plurality of the LED illumination units 60 can be grouped together and arranged in a matrix to form an LED illumination lamp. FIG. 11 illustrates an LED illumination lamp 200 incorporating a plurality of the LED illumination units 60 which are arranged in a matrix in the LED illumination lamp 200. The LED illumination lamp 200 includes a substrate 202 and a plurality of the LED illumination units 60 mounted on the substrate 202. The LED illumination units 60 are regularly arranged on the substrate 202 in rows and columns. In the embodiment, the LED illumination units 60 are arranged in a two-column, two-row matrix. Every two neighboring LED illumination units 60 are arranged in a mirror symmetry relationship.

Figure 12:
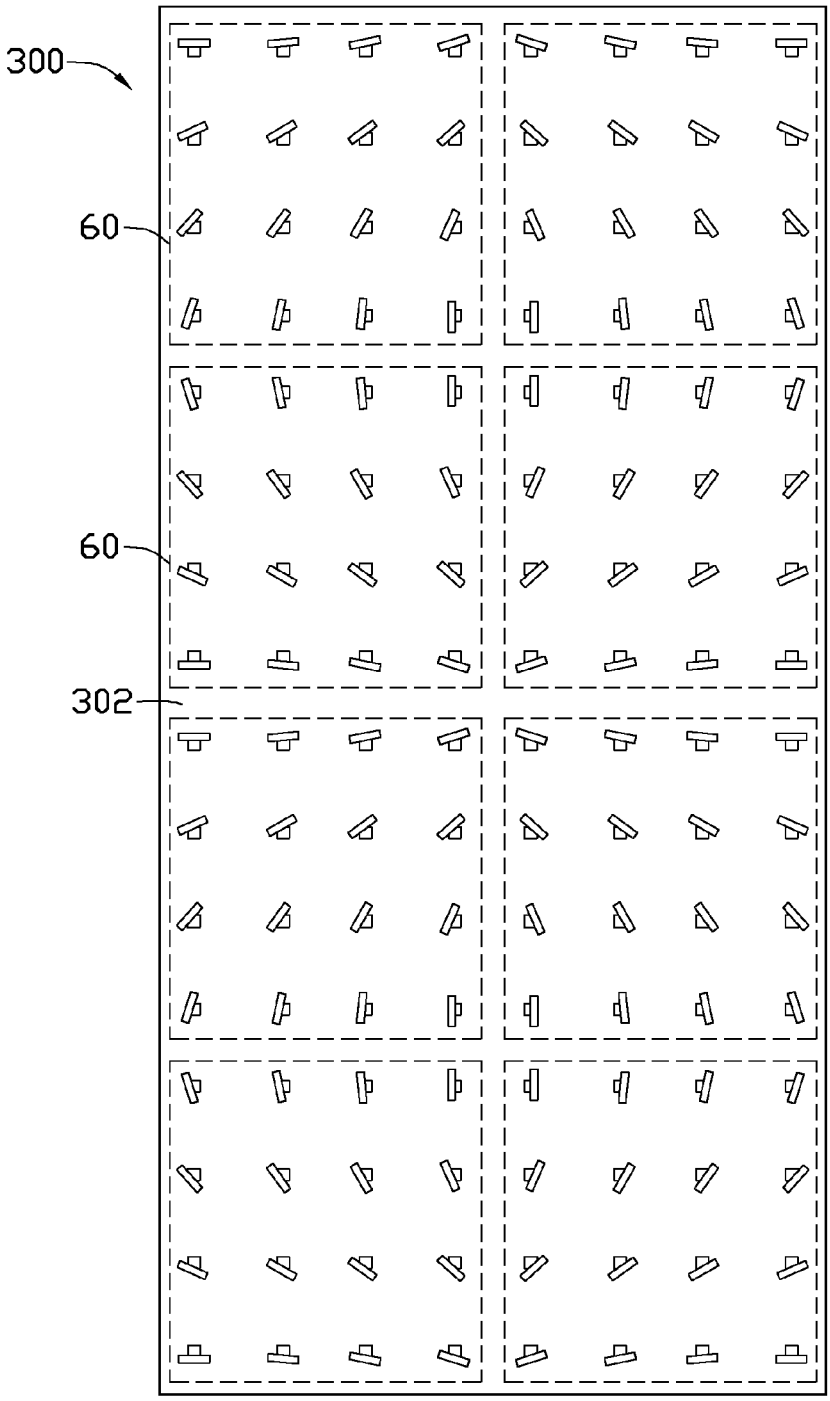
FIG. 12 is a plan view of another LED illumination lamp incorporating a plurality of the LED illumination units of FIG. 10.

FIG. 12 illustrates another LED illumination lamp 300 incorporating a plurality of the LED illumination units 60 which are arranged in a matrix in the LED illumination lamp 300. The LED illumination lamp 300 includes a substrate 302 and a plurality of the LED illumination units 60 mounted on the substrate 302. The LED illumination units 60 are regularly arranged on the substrate 302 in rows and columns. In the embodiment, the LED illumination lamp 300 includes eight LED illumination units 60 which are arranged in a two-column, four-row matrix. The eight LED illumination units 60 are divided into two groups, i.e., a first group at a top side and a second group at a bottom side, wherein the four LED illumination units 60 in each group have the same configuration with the LED illumination units 60 of the LED illumination lamp 200 shown in FIG. 11.

Figure 13:
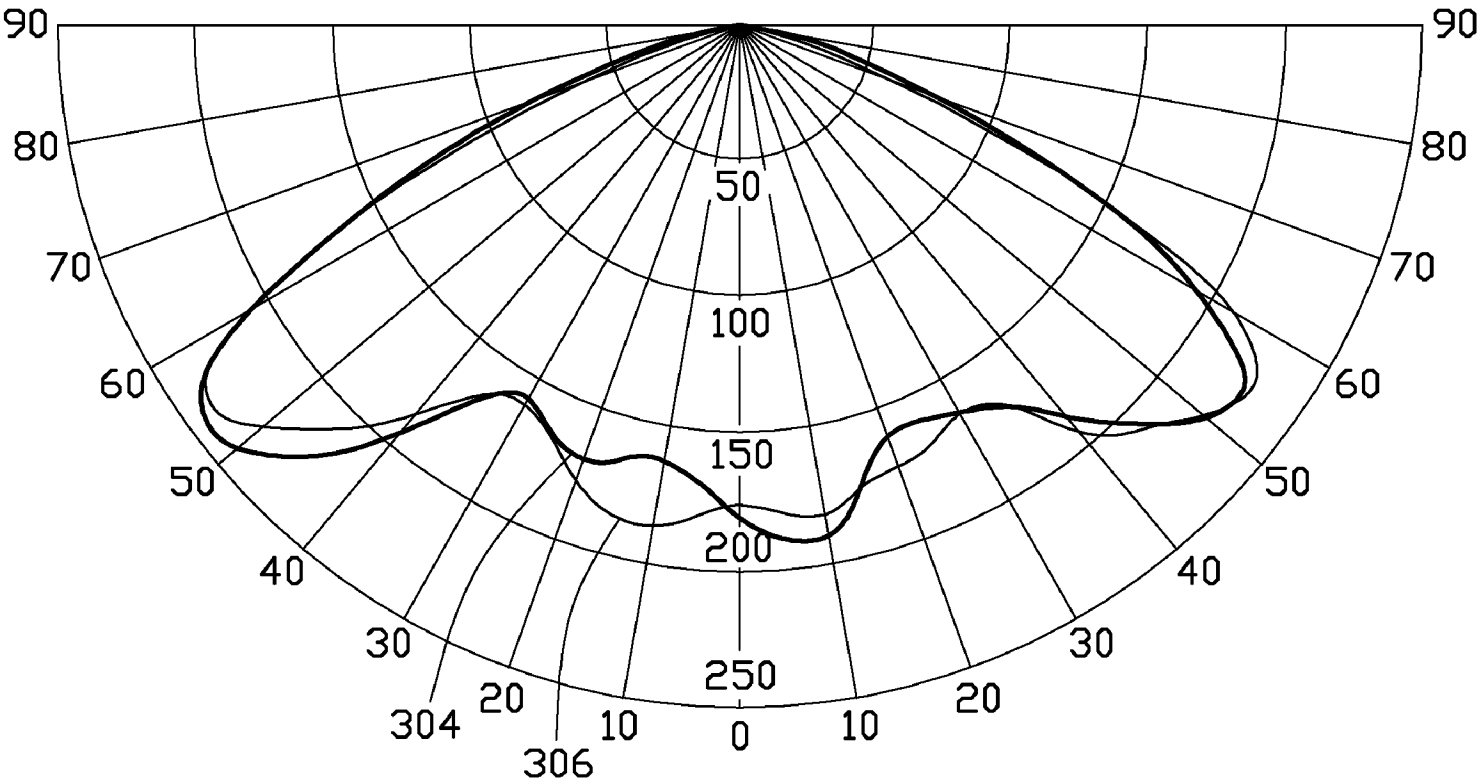
FIG. 13 shows photometric curves of the LED illumination lamp of FIG. 12.
Figure 14:
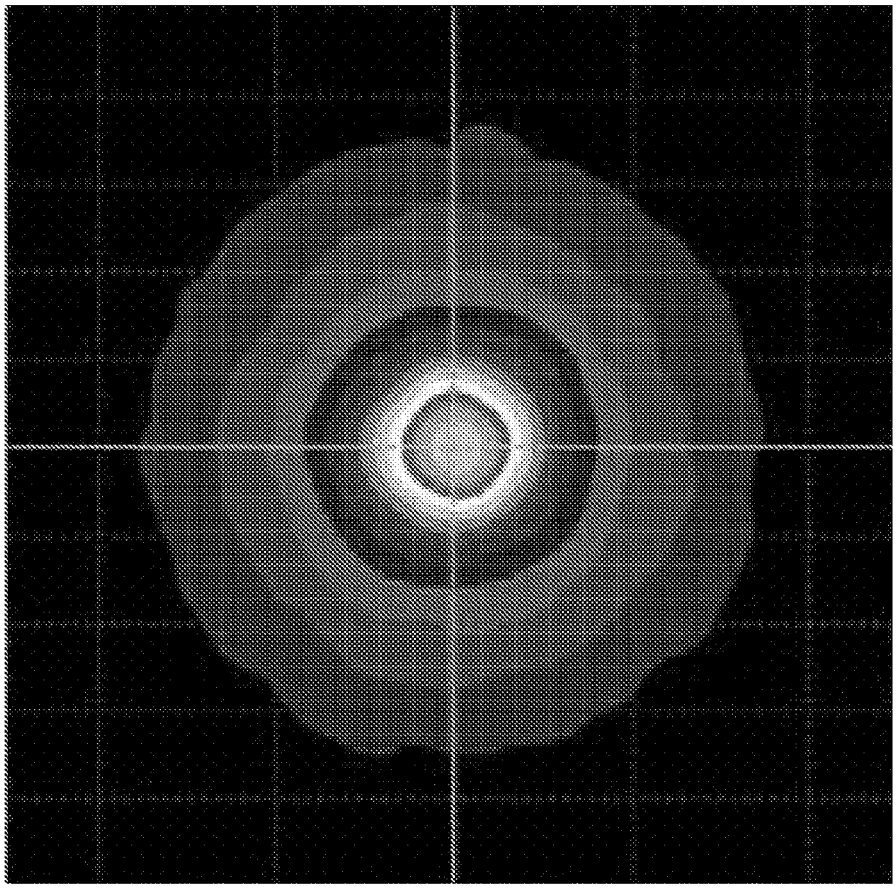
FIG. 14 shows a light pattern of the LED illumination lamp of FIG. 12.

FIG. 13 is a Candela plot showing photometric curves 304, 306 of the LED illumination lamp 300 of FIG. 12. The two photometric curves (i.e., the bold curve 304 and the thin curve 306) have similar shapes and are substantially overlapped, representing that the distribution of the light at the two orthogonal directions are approximate to each other. Thus, the light distribution of the LED illumination lamp 300 can have a desirable shape approximate to a circle as shown in FIG. 14, thereby meeting the Type IV and Type V illumination requirements of IESNA.

It is believed that the present disclosure and its advantages will be understood from the foregoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. An LED illumination lamp, comprising:

a plurality of LED illumination units grouped together and arranged in a matrix on a substrate, each LED illumination unit comprising:

a plurality of LEDs mounted on the substrate and arranged in rows and columns to form an LED array, the LED array having a center and a symmetrical axis across the center, the LEDs being arranged symmetrically on the substrate with respect to the symmetrical axis; and a corresponding number of plate-type light reflectors mounted on the substrate, each light reflector being paired with an LED and disposed immediately adjacent to the LED, each light reflector having a light reflecting surface facing the LED, the light reflectors each defining a mounting angle relative to the symmetrical axis, the mounting angle being an angle from 0 to 90 degrees;

wherein the LEDs are arranged in N rows and M columns on the substrate and the light reflectors are also arranged in N rows and M columns on the substrate wherein N and M are natural number and greater than 1, the mounting angles of the light reflectors relative to the symmetrical axis in each row of light reflectors are varied in such a manner that a right light reflector in each row of light reflectors is deflected with a first predetermined angle relative to a neighboring left light reflector in the same row of light reflectors, and the mounting angles of the light reflectors relative to the symmetrical axis in each column of light reflectors are varied in such a manner that a rear light reflector in each column of light reflectors is deflected with a second predetermined angle relative to a neighboring front light reflector in the same column of light reflectors;

wherein a leftmost light reflector in a rear row of light reflectors is deflected with the first predetermined angle relative to a rightmost light reflector in a neighboring front row of light reflectors; and wherein every two neighboring LED illumination units are arranged in a mirror symmetry relationship.

2. The LED illumination lamp as claimed in claim 1, wherein the LEDs are arranged in a two-row, two-column matrix on the substrate, and the mounting angles defined by the light reflectors of each of the plurality of LED illumination units are the same as each other.

3. The LED illumination lamp as claimed in claim 2, wherein the mounting angles defined by the light reflectors of one of the plurality of LED illumination units are different from the mounting angles defined by the light reflectors of another one of the plurality of LED illumination units.

* * * * *